US008201354B2

(12) United States Patent
Bentley

(10) Patent No.: US 8,201,354 B2
(45) Date of Patent: Jun. 19, 2012

(54) RECOIL SYSTEM FOR THE FOREND OF A FIREARM

(75) Inventor: James K. Bentley, Paso Robles, CA (US)

(73) Assignee: Alliant Techsystems Inc., Minneapolis, MN (US)

( * ) Notice: Subject to any disclaimer, the term of this patent is extended or adjusted under 35 U.S.C. 154(b) by 1 day.

(21) Appl. No.: 12/798,810

(22) Filed: Apr. 12, 2010

(65) Prior Publication Data

US 2011/0035981 A1 Feb. 17, 2011

Related U.S. Application Data

(63) Continuation-in-part of application No. 11/511,805, filed on Aug. 29, 2006, now Pat. No. 7,770,318.

(60) Provisional application No. 60/712,723, filed on Aug. 29, 2005.

(51) Int. Cl.
*F41C 23/06* (2006.01)
*F41C 23/12* (2006.01)
*F41C 23/16* (2006.01)

(52) U.S. Cl. ..... 42/74

(58) Field of Classification Search ..... 42/1.06, 42/73, 74, 124
See application file for complete search history.

(56) References Cited

U.S. PATENT DOCUMENTS 552,334 A * 12/1895 Sanger ..... 42/74
926,529 A * 6/1909 Wesson ..... 42/74
2,104,129 A * 1/1938 Kress ..... 42/71.01
2,435,217 A * 2/1948 Howell, Jr. ..... 42/72
2,731,753 A * 1/1956 Mathieu ..... 42/74
2,826,848 A * 3/1958 Davies ..... 42/71.01
2,970,398 A * 2/1961 Crouch ..... 42/69.01
3,018,694 A * 1/1962 Browning ..... 89/159
3,580,132 A * 5/1971 Vartanian ..... 89/130
3,650,060 A * 3/1972 Schubert ..... 42/1.06
4,132,024 A * 1/1979 Pachmayr et al. ..... 42/71.02
4,156,979 A * 6/1979 Katsenes ..... 42/1.06
4,492,050 A * 1/1985 Kagehiro ..... 42/1.06
4,502,238 A * 3/1985 Farrar et al. ..... 42/72
4,503,632 A * 3/1985 Cuevas ..... 42/1.06
4,514,921 A * 5/1985 Burkleca ..... 42/1.06
4,976,038 A * 12/1990 Nattrass ..... 42/136
4,986,018 A * 1/1991 McDonald, Jr. ..... 42/1.06
5,048,215 A * 9/1991 Davis ..... 42/72
5,068,992 A * 12/1991 Velezis et al. ..... 42/72
5,417,002 A * 5/1995 Guerra ..... 42/72
5,524,374 A * 6/1996 Gernstein ..... 42/1.06
5,722,195 A * 3/1998 Bentley et al. ..... 42/74
6,055,760 A * 5/2000 Cuson et al. ..... 42/74
2007/0006508 A1* 1/2007 Baker et al. ..... 42/71.02
2007/0137087 A1* 6/2007 Florea et al. ..... 42/90

* cited by examiner

*Primary Examiner* — Troy Chambers

(74) *Attorney, Agent, or Firm* — Wooten & Shaddock, PLC

(57) ABSTRACT

A firearm having a receiver having a front end and a rear end, an elongated gun barrel having a front end and a rear end, the rear end of the gun barrel being connected to the front end of the receiver; an elongated long gun stock having a butt portion, a middle portion and a front portion; the receiver and the gun barrel being supported in the long gun stock; and recoil reduction means attached to the front portion of the long gun stock.

15 Claims, 11 Drawing Sheets

RECOIL SYSTEM FOR THE FOREND OF A FIREARM

CROSS-REFERENCE TO RELATED APPLICATIONS

This is a Continuation-In-Part of U.S. patent application Ser. No. 11/511,805, filed Aug. 29, 2006, now U.S. Pat. No. 7,770,318 which claims priority from U.S. Provisional Patent Application Ser. No. 60/712,723, filed Aug. 29, 2005, the disclosures of which are incorporated herein in their entireties by reference.

BACKGROUND OF THE INVENTION

1. Field of the Invention

The present invention is directed generally to firearms and more specifically to a recoil system for rifles and shotguns. More specifically, the present invention is directed to recoil reduction systems that are embedded within the stock and/or grip of a firearm or other device.

2. Description of Related Art

The present invention is directed generally to a folding stock assembly. More specifically, the present invention is directed to a folding stock assembly that can be mounted on the rearwardly extending neck portion of a handgrip for a firearm.

One age-old problem that exists with firearms is the fact that many of them have a severe recoil that affects the person firing the weapon. In firearms such as shotguns and rifles, the rear end of the butt stock is positioned against the shooter's shoulder and recoil often causes the shooter to raise the front of the firearm each time the weapon is fired and the recoil can result in pain and/or bruising to the shoulder area of the person firing the weapon. One example of the recoil being detrimental to a shooter's accuracy is where the firearm is a shotgun being used for skeet shooting by a male or female.

In the past, the best prior art recoil systems for the butt stock of a firearm have been very expensive and the inexpensive systems did not function properly. Two examples of expensive systems are a hydro-coil fluid dampening system and a pneumatic air chamber system. The present day inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock too loosely.

One of the improvements in recoil systems for a firearm is illustrated in the Bentley et al U.S. Pat. No. 5,722,195. It has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

Another recent improved recoil system for a firearm is illustrated in the Bentley et al U.S. Pat. No. 5,752,339. This patent discloses a recoil system for the butt stock of a firearm having a recoil suppressor assembly whose front end is mounted in the cavity in the rear end of the gun stock. The piston ram of the recoil suppressor assembly in its static position extends rearwardly into a bore hole cavity of an elongated recoil housing. When the firearm is shot, the elongated body portion of the recoil suppressor assembly and its transversely extending mounting flange portion instantaneously travel rearwardly into the bore cavity with the bore hole of the body housing reciprocally traveling over the piston ram. A coil spring whose front end is secured to the front end of the body portion and whose rear end is secured to a cam assembly returns the elongated body portion to a static position once the recoil of the firearm has been suppressed.

SUMMARY OF THE INVENTION

The recoil reduction system has been designed to be used with firearms such as shotguns and rifles. In each instance, the recoil reduction structure is mounted forwardly of the receiver of the firearm. In one embodiment, the recoil reduction structure is incorporated on the bottom wall of a forend and having an upright handgrip secured to the bottom of the forend. The recoil reduction structure incorporates an inverted T-shaped rail extending downwardly from the forend that travels reciprocally forward and back in a track formed in the top end of the handgrip member. The handgrip member is gripped by the shooter's forward hand and when the gun is fired, the recoil action takes place forwardly of the receiver. The shooter can hold the firearm with the butt of the firearm spaced from the shooter's shoulder with out receiving a kick that stuns or bruises the shooter's shoulder.

The recoil reduction system can also be incorporated into the structure of a forend that does not have a handgrip member. The recoil reduction system can also be installed into the long gun stock of a rifle at a location forward of the receiver. Again in this instance, the shooter's front hand would be gripping the cover member located beneath a cutout cavity in the bottom surface of the long gun stock.

Another benefit of having the recoil reduction system mounted in front of the receiver is that in the version with the handgrip extending downwardly, the handgrip has little or no recoil to it when the firearm is fired. Therefore when incorporating a light mounting portion on the front of the substantially stationary hand gripping member, the light projected forwardly maintains a stable beam of light.

Accordingly, this invention provides a recoil system for a firearm that minimizes the amount of recoil force experienced by the person firing the weapon.

This invention separately provides a recoil system for a firearm that minimizes pain to the shoulder to the person firing the weapon due to recoil forces.

This invention separately provides a recoil system for a firearm that requires limited modification to the forend of a shotgun.

This invention separately provides a recoil system for a firearm that utilizes a block of elastomer material.

This invention separately provides a recoil system for the butt stock of a firearm that is easily mounted on the magazine tube of a shotgun.

This invention separately provides a recoil system for shotguns and rifles that is economical to manufacture and market.

This invention separately provides a double recoil system for a handgrip attached to a forend.

This invention separately provides a recoil reduction system that can be installed into a long gun stock such as used with rifles.

This invention separately provides a recoil reduction system that allows a battery powered light to be supported by a handgrip member positioned forwardly of the receiver of a shotgun.

These and other features and advantages of this invention are described in or are apparent from the following detailed description of the exemplary, non-limiting embodiments.

DESCRIPTION OF THE DRAWINGS

The exemplary embodiments of this invention will be described in detail, with reference to the following figures, wherein like reference numerals refer to like parts throughout the several views, and wherein.

DESCRIPTION OF THE PREFERRED EMBODIMENT

For simplicity and clarification, the design factors and operating principles of the recoil system for a firearm according to this invention are explained with reference to various exemplary embodiments of a recoil system for a firearm according to this invention. The basic explanation of the design factors and operating principles of the recoil system for a firearm is applicable for the understanding, design, and operation of the recoil system of this invention.

It should also be appreciated that the terms "firearm", "rifle", and "shotgun" are used for basic explanation and understanding of the operation of the systems, methods, and apparatuses of this invention. Therefore, the terms "firearm", "rifle", and "shotgun" are not to be construed as limiting the systems, methods, and apparatuses of this invention.

Figure 1:
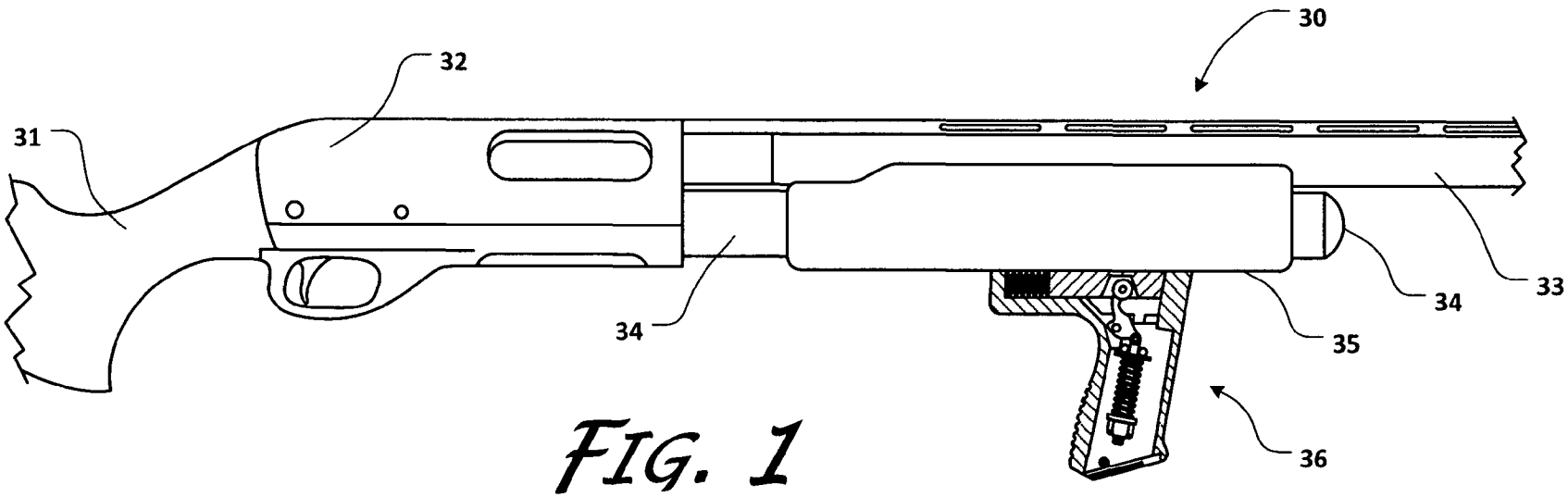
FIG. 1 is a side elevation view of a shotgun illustrating the recoil reduction system mounted in a handgrip member secured to the bottom of the forend.
Figure 5:
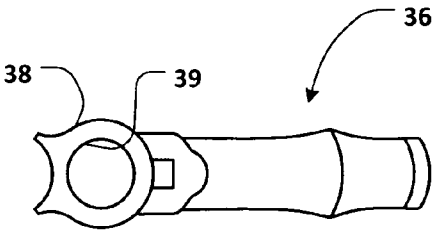
FIG. 5 is a front elevation view of FIG. 2.
Figure 3:
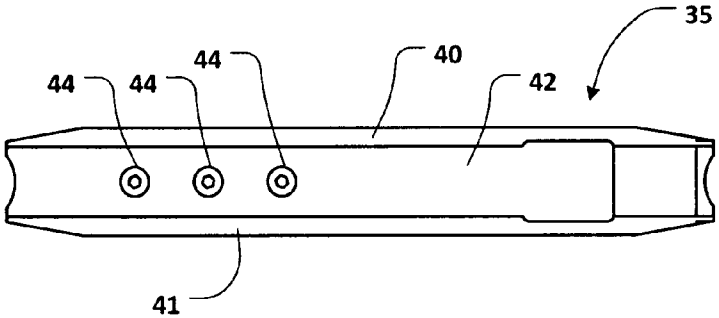
FIG. 3 is a top plan view of the forend illustrated in FIG. 2.

The recoil system for a firearm will now be described by referring to FIGS. 1-9 and 18-19 of the drawings. A shotgun 30 is illustrated in FIG. 1 having butt stock 31, a receiver 32, a gun barrel 33, a magazine 34, a forend 35 and a handgrip member 36. The recoil reduction system is mounted within handgrip member 36.

Figure 4:
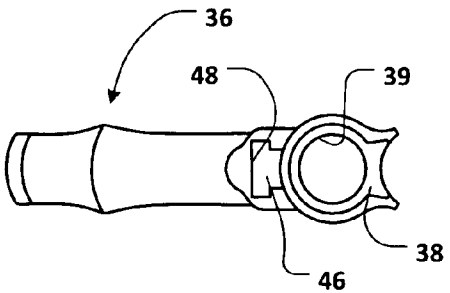
FIG. 4 is a rear elevation view of FIG. 2.
Figure 2:
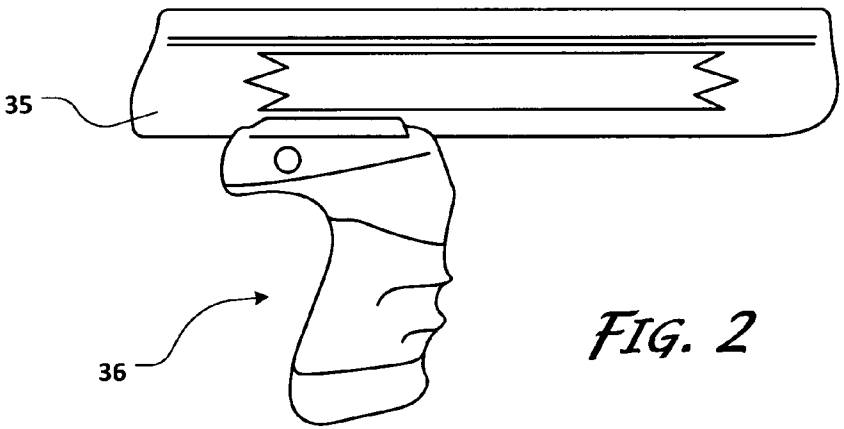
FIG. 2 is an enlarged side elevation view of a forend having the recoil reduction system mounted in the handgrip member.

FIGS. 2-5 and 18-19 illustrate views of the forend 35 from various sides and angles. FIG. 4 is a rear elevation view and it shows that forend 35 has a generally U-shaped transverse profile with a ring 38 formed at its front end. Ring 38 has a bore hole 39 that would telescope over magazine 34. The remainder of forend 35 has a left side wall 40, a right side wall 41, and a bottom wall 42. A plurality of screws 44 secure an inverted T-shaped rail 46 to the bottom surface of forend 35. Handgrip member 36 has a longitudinally extending T-shaped track 48 along which rail 46 reciprocally travels.

Track 48 has a chamber formed in its rear end that receives an elastomer block 51 having a cylindrical shape. Track 48 and chamber 49 are formed in track housing 52 that extends rearwardly from the top end of handgrip 36. A cavity 53 is formed in the bottom surface of rail 46. A primary chamber 54 extends upwardly through almost all of the height of handgrip member 36. A lever 56 is pivotally mounted in primary chamber 54 by a pivot pin 57.

A cam roller 58 is mounted on the top end of lever 56 by a pin 59. A retainer ring 61 is mounted on the bottom end of lever 56 by a pin 62. A coil spring 63 has its top hook member 64 captured in retainer 61. Coil spring 63 has a bottom hook member 65 captured by the rigid pin 66.

Forend 35 is rigidly secured to the magazine 34 or other structure that is rigidly secured to receiver 32. When the shotgun is fired, a forend 35 recoils rearwardly causing rail 46 to also travel in the same direction. The elastomer block 51 is compressed to reduce some of the recoil. Cam roller 58 is pivoted rearwardly about pivot pin 57 causing coil spring 63 to be stretched and then returned to its static position and this also provides recoil reduction.

Figure 7:
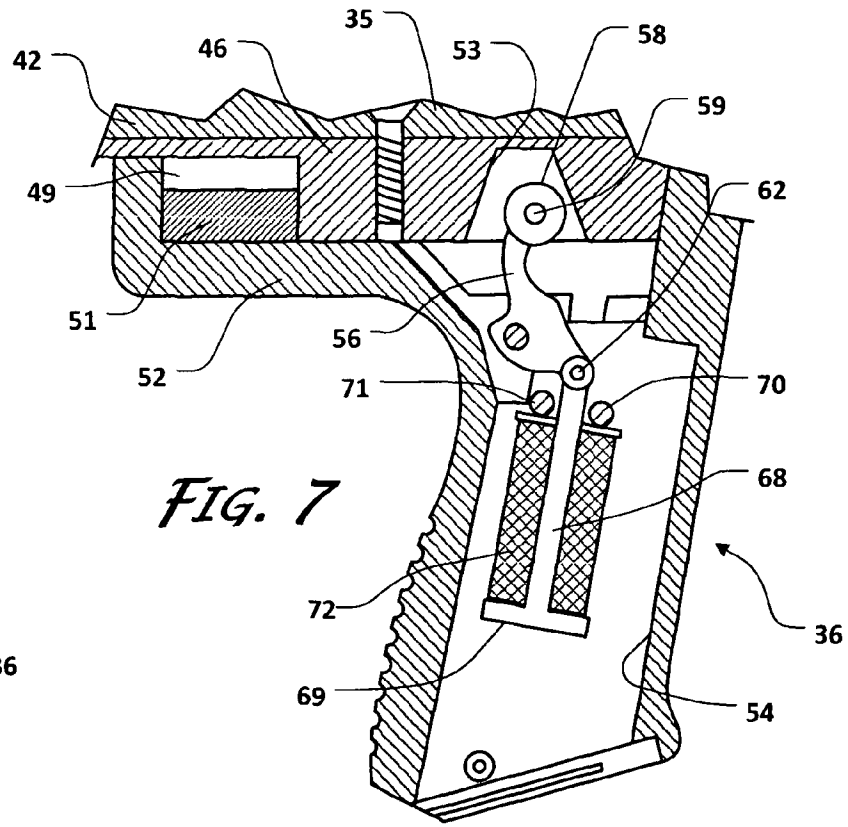
FIG. 7 is a vertical cross section view illustrating a second embodiment of the recoil reduction system mounted in the handgrip member.
Figure 6:
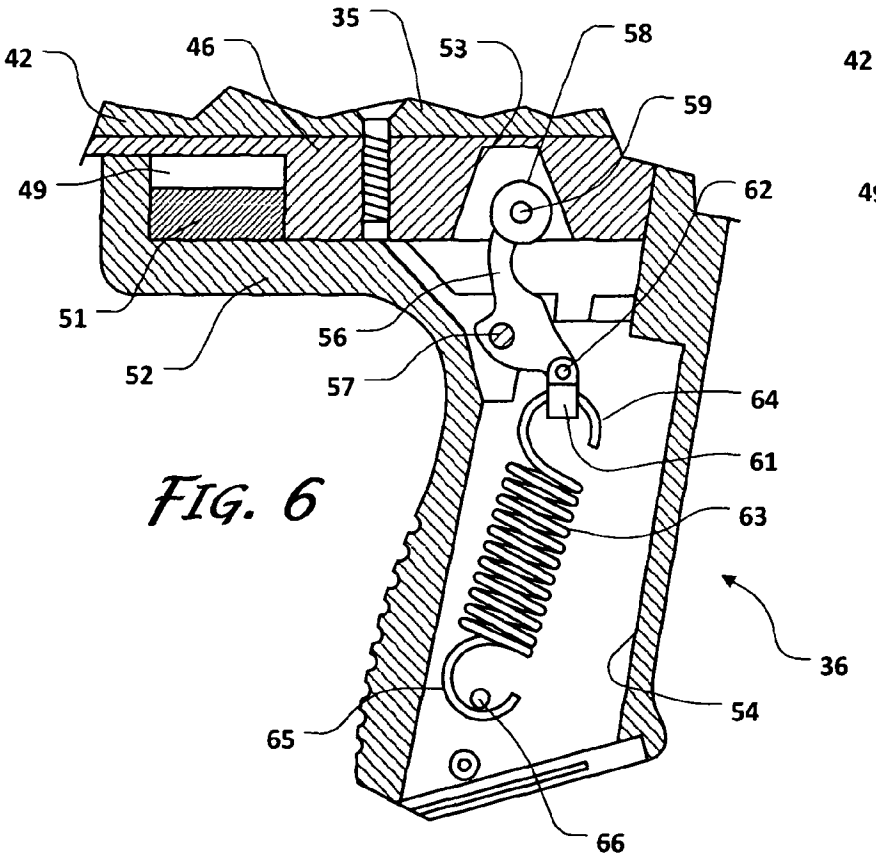
FIG. 6 is a vertical cross section view illustrating a first embodiment of the recoil reduction system mounted in the handgrip member.

The first variation of the recoil reducing structure in the handgrip member 36 is illustrated in FIG. 7. A rod 68 has its bottom end connected to plate 69 and its top end is pivoted on pin 62. An elastomer tube 70 is telescoped over rod 68 and its top end bears against pins 70 and 71. Rearward travel of rail 46 will pivot lever 56 rearwardly causing elastomer tube 70 to be compressed and reduce recoil.

Figure 8:
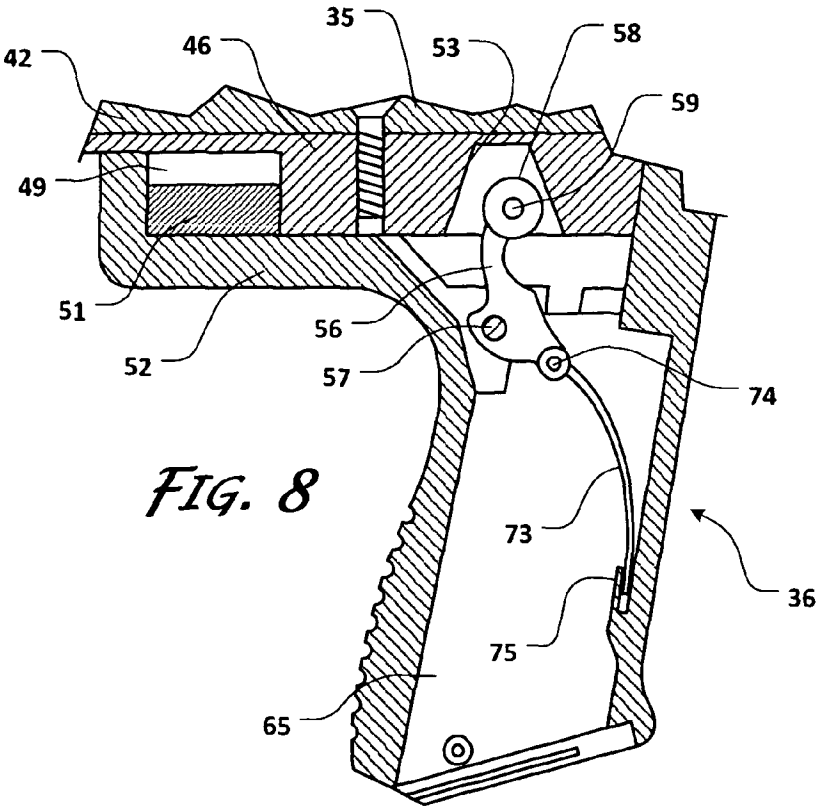
FIG. 8 is a vertical cross section view illustrating a third embodiment of the recoil reduction system mounted in the handgrip member.
Figure 10:
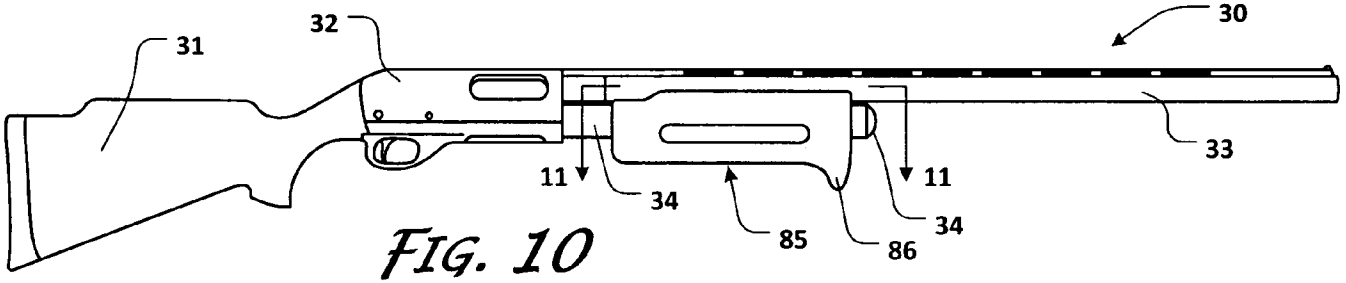
FIG. 10 is a side elevation view of a shotgun illustrating the recoil reduction system mounted within the interior of the forend member.

A second alternative recoil reducing structure is illustrated in FIG. 8. It has a leaf spring 73 having a stressed curvature in its static state. Its top end is captured by attachment structure 74 on the bottom end of lever 56 and its bottom end is captured in slot 75 in the inner wall of handgrip member 36. Rearward travel of rail 46 will compress elastomer block 51 causing recoil reduction. Likewise, spring 73 will be stretched upwardly when lever 56 is rotated rearwardly. This also reduces the recoil force.

Figure 9:
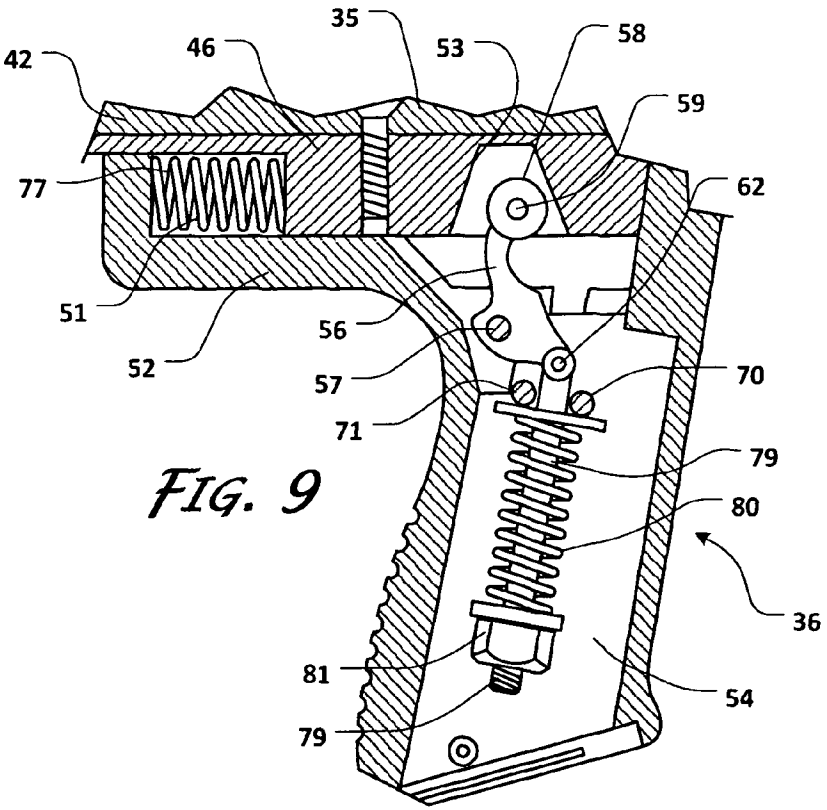
FIG. 9 is a vertical cross section view illustrating a fourth embodiment of the recoil reduction system mounted in the handgrip member.

A third alternative recoil structure is illustrated in FIG. 9. It has a coil spring 77 in rail chamber 49. A screw 79 has its top end captured by pin 62. A coil spring 80 surrounds screw 79 and has a nut 81 on its bottom end. Pins 70 and 71 press against the top end of spring 80. When rail 46 travels rearwardly, coil spring 77 reduces the recoil force. Also as lever 56 has its to end pivoted rearwardly, spring 80 would be compressed to also reduce recoil force.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit or scope of the invention as defined in the appended claims.

Figure 11:
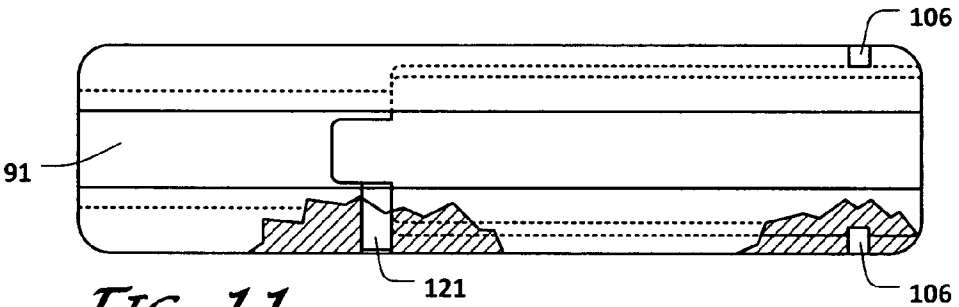
FIG. 11 is a top plan view of the forend member illustrated in FIG. 10.
Figure 12:
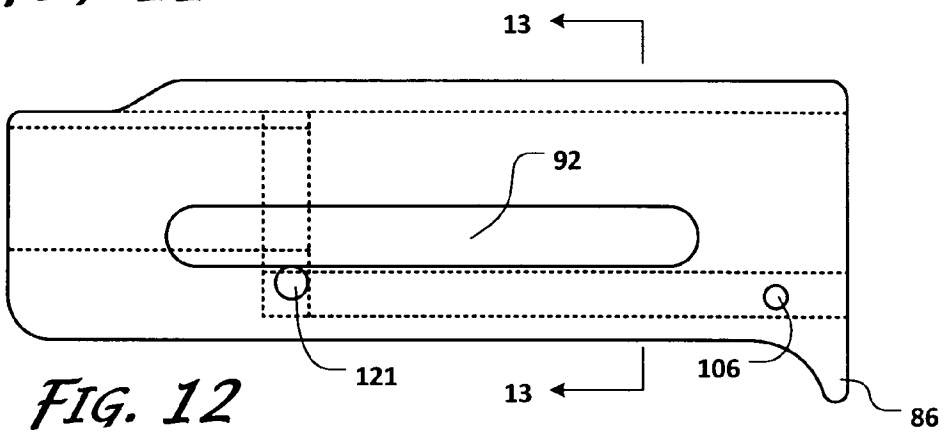
FIG. 12 is a right side elevation view of the forend member illustrated in FIG. 10.
Figure 13:
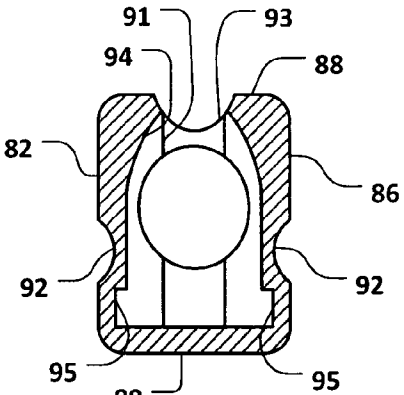
FIG. 13 is a cross sectional view taken along lines 13-13 of FIG. 12.
Figure 15:
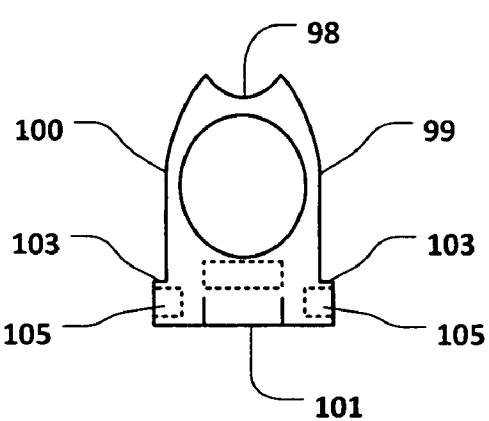
FIG. 15 is a front elevation view of the support unit illustrated in FIG. 14.

In FIGS. 10-17, the recoil reduction system is mounted inside forend 85. Forend 85 has a handrest stop 86 extending downwardly from its forward end to prevent the shooter's hand from slipping off the forend. FIGS. 11-13 illustrate different views of forend 85. Forend 85 is generally U-shaped throughout most of its length. It has a left side wall 86, a right side wall 87, a top wall 88, and a bottom wall 89. A portion of forend 85 has a connecting wall member 91 at its top end and a bore hole 83 is formed for telescopically receiving the magazine 34. Finger grooves 92 are formed along the outside surface of the respective left and right side walls. Forend 85 has an interior cavity 94 having outwardly extending tracks 95 adjacent its bottom end.

The structure for mounting the recoil reduction system is illustrated in FIGS. 14-17 and is generally identified as support unit 97. Support unit 97 is a solid piece of material that is telescopically received in cavity 94 of forend 85. Support unit 97 has a top wall 98, a left side wall 99, a right side wall 100, a bottom wall 101 and rails 103 extend outwardly from the respective side walls adjacent bottom wall 101. A bore hole 104 extends the length of support unit 97 so that it telescopes over magazine 34. Grooves 105 extend inwardly into rails 103 and these grooves receive set screws 106 extending inwardly from the side walls of forend 85.

Figure 17:
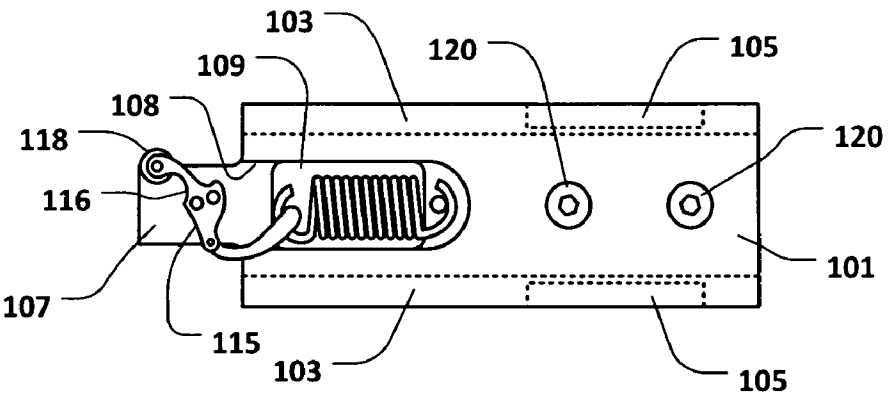
FIG. 17 is a bottom plan view of the support unit illustrated in FIG. 14.
Figure 14:
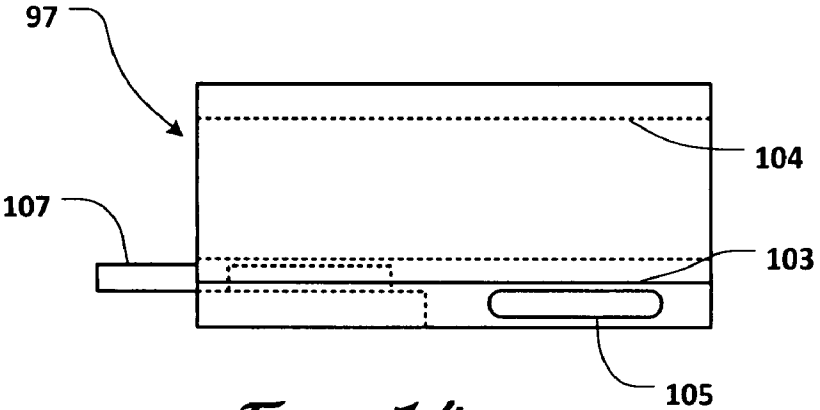
FIG. 14 is a side elevation view of the support unit for the recoil reduction structure received in the forend illustrated in FIGS. 11-13.
Figure 16:
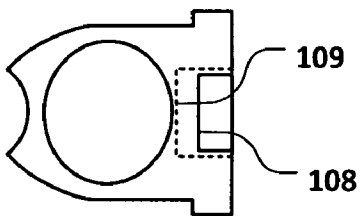
FIG. 16 is a rear elevation view of the support unit illustrated in FIG. 14.
Figure 19:
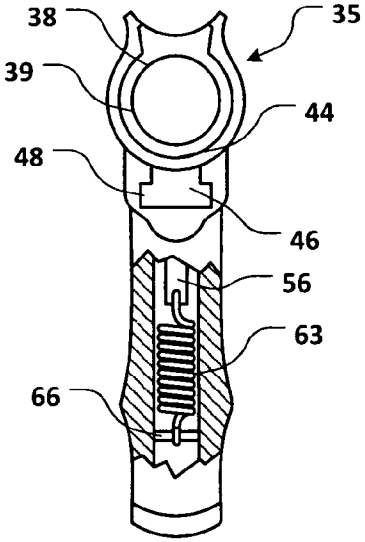
FIG. 19 is a front elevation view of FIG. 18 with portions shown in cross section.
Figure 18:
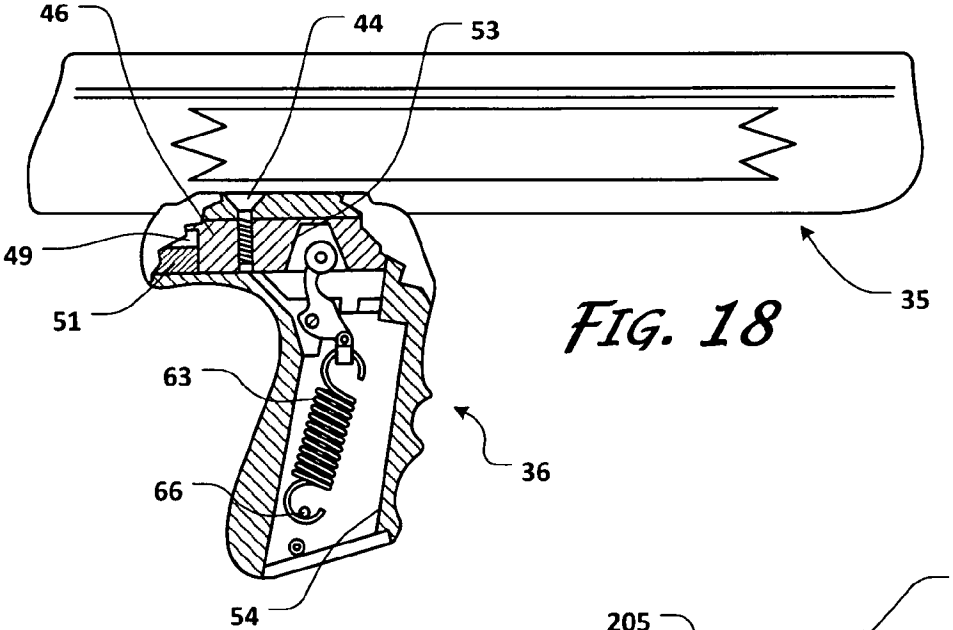
FIG. 18 is an enlarged view of FIG. 2 with portions of the handgrip member illustrated in cross section.

Bottom wall 101 is best seen in FIG. 17. It has a tongue 107 extending from its front end. An outer cavity 108 is formed in bottom wall 101 for receiving part of the hardware of the recoil reduction system. A second deeper cavity 109 accommodates the bottom portion of coil spring 110. One end of coil spring 110 is secured to a pin 112 and the other end is secured to a retainer member 113 whose free end is secured to one end of lever 115. Lever 115 is secured to tongue 107 by a pivot pin 116. A cam roller 118 is supported by a pin on the other end of lever 115. Attachment screws 120 secure support unit 97. As support unit 97 travels rearwardly, cam roller 118 engages pin 121 extending into the side wall of forend 85. It engages cam roller 118 causing it to rotate about pivot pin 116 causing spring 110 to be stretched and reduce recoil.

In FIGS. 20-24, the recoil reduction system is mounted in a rifle 123. Rifle 123 has a recoil suppression butt stock assembly 125, a receiver 126, a gun barrel 127, and a long gun stock 128. For the embodiment to be discussed, long gun stock 128 would have a removable front piece 130. It is to be understood that a single long gun stock 28 could also have a primary recess 132 integrally formed in a single long gun stock. In the illustrated embodiment, stock cover 134 can only be installed by removing front piece 130.

Long gun stock 128 has three identifiable portions, butt stock portion 136, middle portion 137, and front portion 138. Front portion 138 is located forward of receiver 128. Primary recess 132 has a bottom wall 140. Bottom wall 140 has rails 142 extending along its lateral edges and above it are formed an inwardly extending track 144. A recess 146 is formed in bottom wall 140 and lever 147 is mounted on a pivot pin 148 therein. A cam roller 149 is pivotally secured to one end of lever 147. A retainer member 150 is secured to the other end of 147 and it captures one end of spring 152. The other end of spring 152 is captured by a pin 153. The top portion of spring 152 extends into a deeper recess 155. A cover member 160 has a front end 161, a rear end 162, a left side wall 163, and a right side wall 164.

Finger grips 167 are formed in both side walls 163 and 164. Cover member 160 has a bottom wall 170 having a bore hole 172 therein. Tracks 174 are formed on the inner side wall surfaces and they telescopically receive rails 142. A screw 176 extends upwardly through bore hole 172 and is threaded into bottom end of tapered nut 178. Once cover 160 is slid onto rails 142, screw 176 is tightened which causes tapered nut 178 to push upwardly until it contacts cam roller 149 and preloads spring 152. The length of cover member 160 is about 1 inch short of the length of primary recess 132.

When the rifle is fired, long gun stock 128 will travel rearwardly while cover member 160 is held stationary by the forward hand of the person holding the rifle. Cam roller 149 will contact tapered nut 178 causing lever 147 to pivot forwardly causing spring 152 to be stretched thereby reducing the recoil force.

Figure 26:
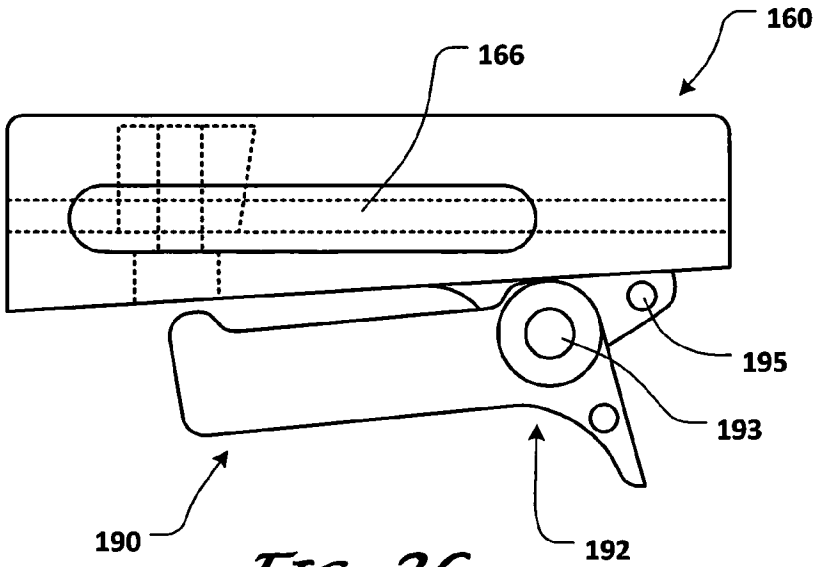
FIG. 26 is a side elevation view of the alternative cover member showing the handgrip member in its retracted position.
Figure 25:
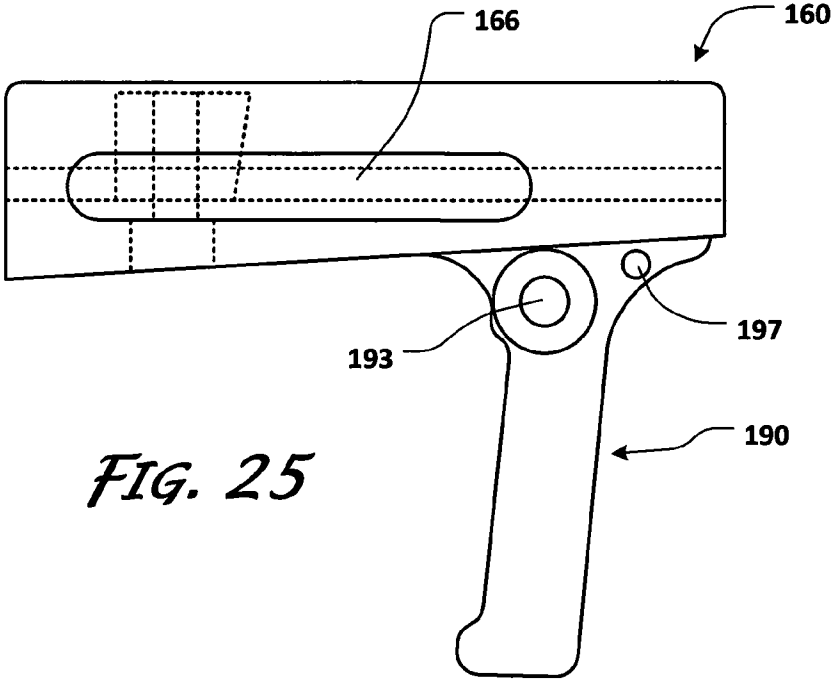
FIG. 25 is a side elevation view of an alternative embodiment of the cover member having a retractable handgrip member secured to its bottom surface.

In FIGS. 25 and 26, cover member 160 is illustrated as having a handgrip 190 with its top end pivotally secured to hinge assembly 192. Handgrip member 190 rotates around pivot pin 193 to its retracted position. When handgrip member 190 is in its down position, bore holes 194 and 195 align to receive a locking pin 197.

Figure 27:
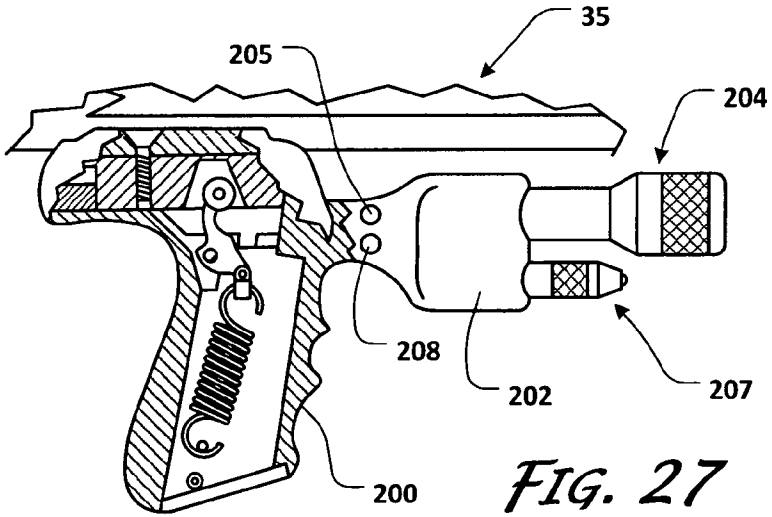
FIG. 27 is a side elevation view illustrating a flashlight and a laser light mounted on the front end of a handgrip member.
Figure 20:
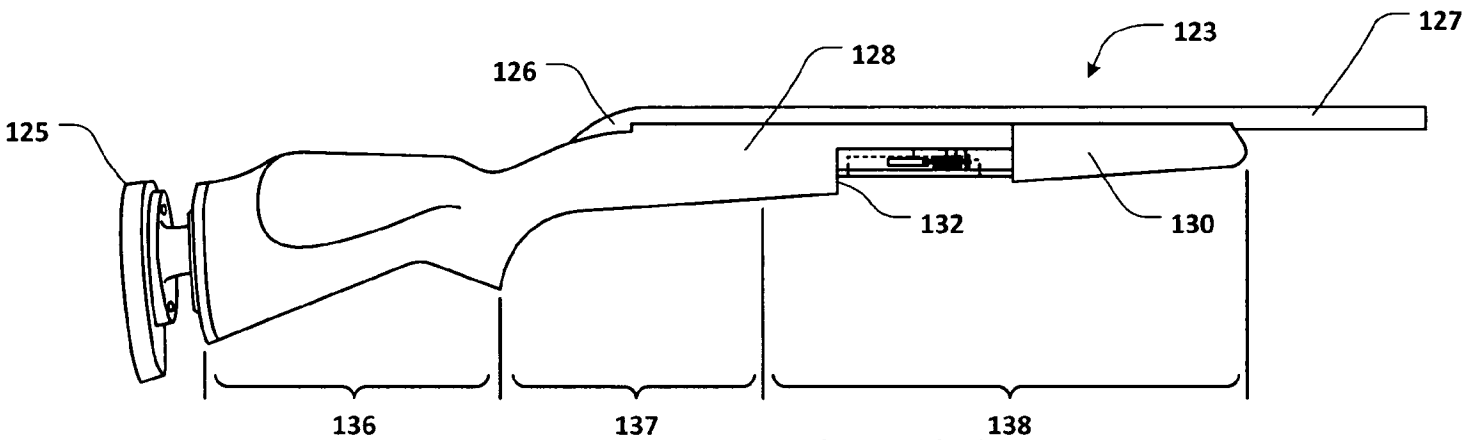
FIG. 20 is a side elevation view of a rifle having a recoil reduction system positioned forwardly of the receiver in the bottom of the long gun stock.
Figure 21:
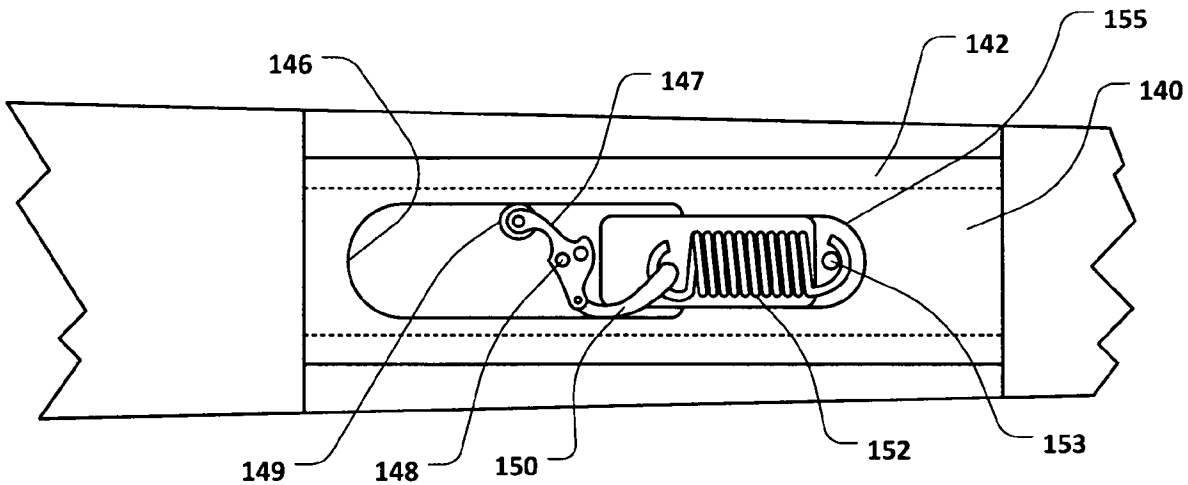
FIG. 21 is a partial bottom plan view of FIG. 20.
Figure 24:
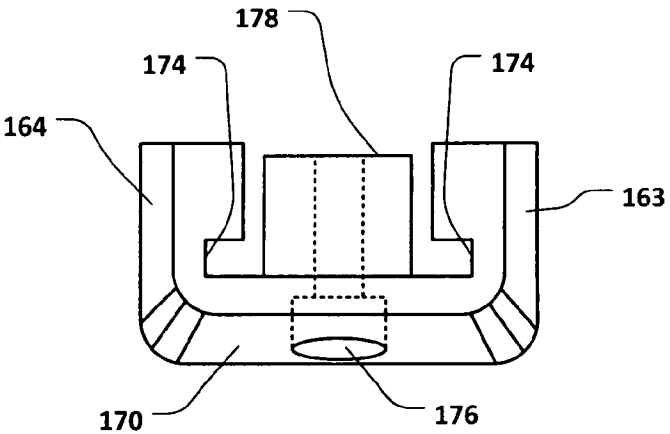
FIG. 24 is a front elevation view of the cover member.
Figure 22:
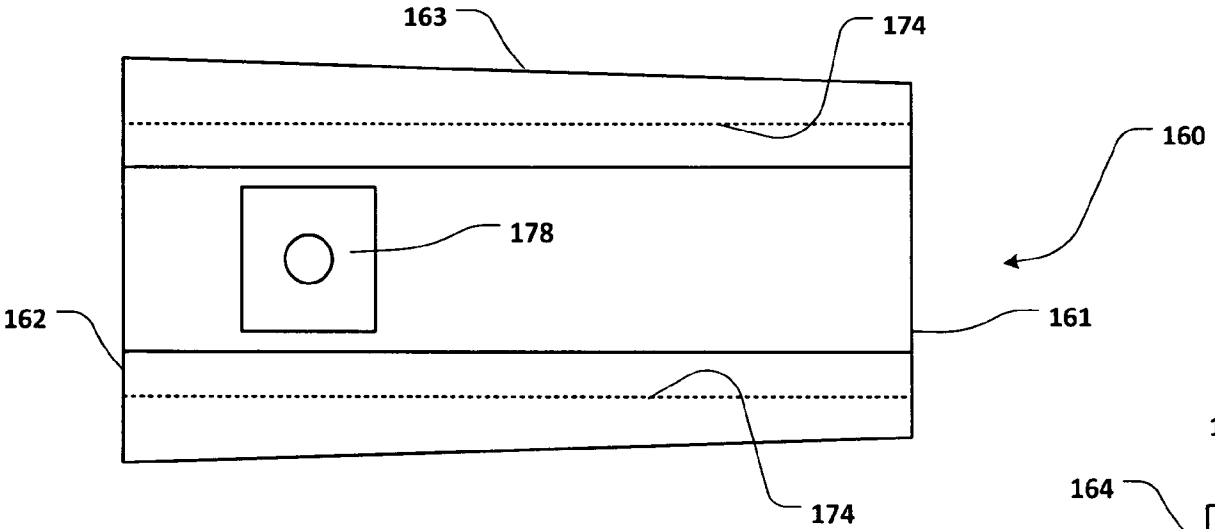
FIG. 22 is a top plan view of the cover member.
Figure 23:
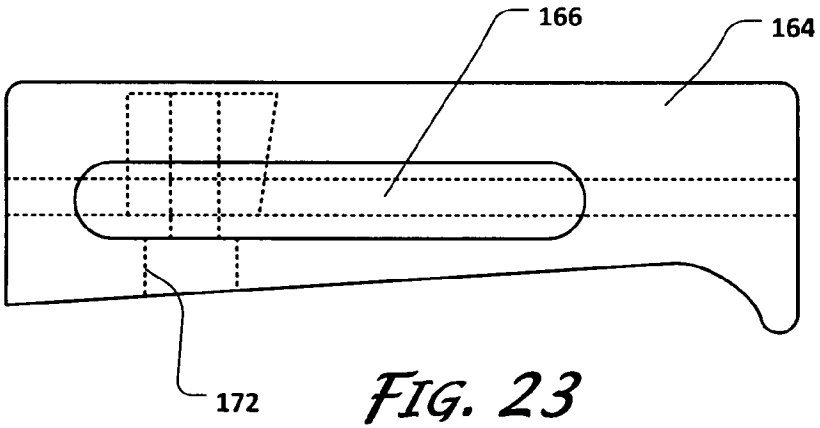
FIG. 23 is a side elevation of the cover member.

FIG. 27 is a side elevation view illustrating a flashlight and a laser light mounted on the front end of a handgrip member.

Figure 29:
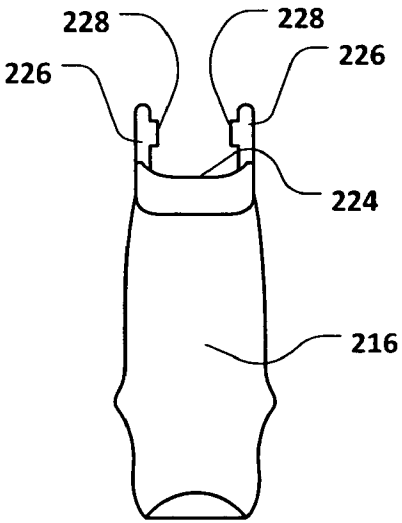
FIG. 29 is a rear elevation view of the pistol grip shown in FIG. 28.
Figure 28:
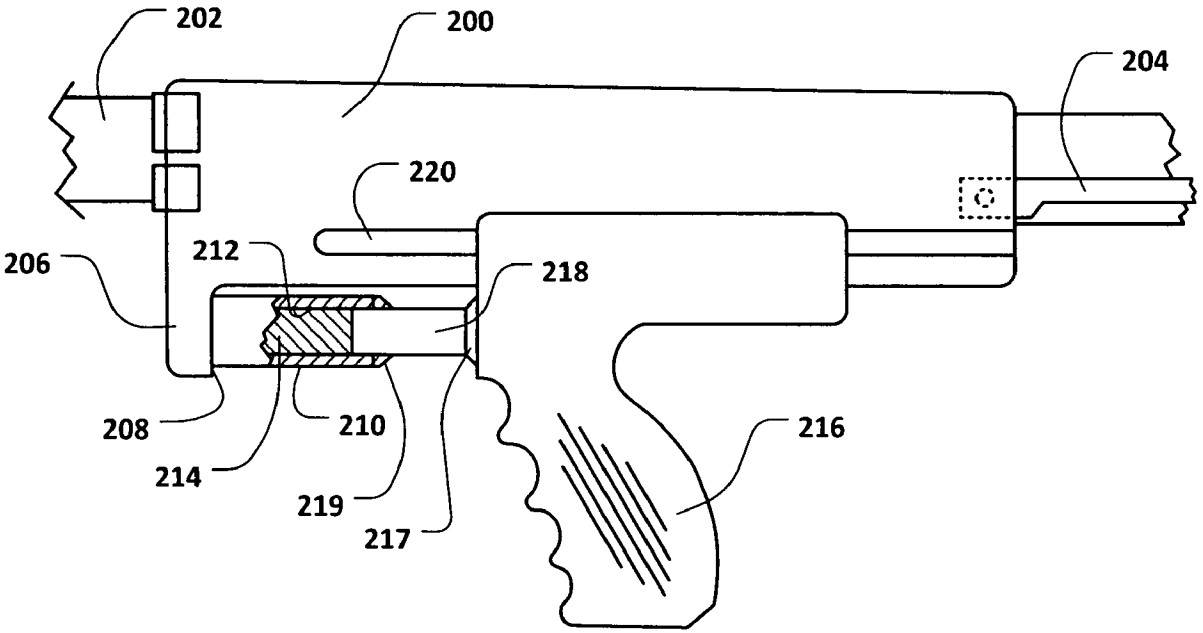
FIG. 28 is a side elevation view of a shotgun illustrating an alternative recoil reduction system mounted in the bottom of the forend in front of the pistol grip.

An alternative recoil reduction system is illustrated in FIGS. 28 and 29. The forend 200 has a longitudinally extending bore that telescopically receives shell tube 202. The action tube arms 204 actuate the mechanism for taking a new shell from shell tube 202. The front end of forend 200 has a downwardly extending tab 206 from its front end. Tab 206 has a rear surface 208 with a cylindrical tube 210 extending rearwardly therefrom. Cylindrical tube 210 has a bore hole 212 having an open rear end. An elastomer tube 214 is telescopically received in bore hole 212.

Piston 218 has its rear end connected to pistol grip 216 by a cap 217 that is screwed into pistol grip 216 and there is also structure that prevents piston 218 from being pulled out of pistol grip 216. Its front end is received in bore hole 212 and bears against the rear end of elastomer tube 214. A cap 219 is screwed into the rear end of cylindrical tube 210 and there is also structure that prevents the front end of piston 218 from being pulled out of the rear end of cylindrical tube 210. A longitudinally extending keyway 220 is formed in the outer surface of the left and right sides of forend 200.

The rear end of pistol grip 216 is illustrated in FIG. 29. Pistol grip 216 has a channel 224 in its top end that forms upstanding walls 226 that each have an inwardly extending rail 228 that mates with the respective keyways 220 and reciprocally travels therein. When the shotgun is fired, forend 200 recoils rearwardly while the forward hand of the shooter keeps the pistol grip relatively stationary. The force of the recoil is dampened by the elastomer tube 214 that is compressed by piston 218. Elastomer tubes of different compressibility can be used.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit of scope of the invention as defined in the appended claims.

While this invention has been described in conjunction with the exemplary embodiment(s) outlined above, it is evident that this invention is not limited to particular variation(s) set forth and many alternatives, adaptations, modifications, and variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Such alternatives, adaptations, modifications, and variations should and are intended to be and are comprehended within the meaning and range of equivalents of the disclosed exemplary embodiment(s) and may be substituted without departing from the true spirit and scope of the invention. Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. A firearm comprising:

a receiver having a front end and a rear end, a gun barrel having a front end and a rear end, said rear end of said gun barrel being connected to said front end of said receiver;

a gun stock having a butt portion, a middle portion, and a front portion;

said receiver being coupled to at least a portion of said gun stock;

and recoil reduction means attached proximate to said front portion of said gun stock, wherein said recoil reduction means comprises a cam roller, a lever, and a leaf spring.

2. The firearm of claim 1, wherein said firearm is a shotgun.

3. The firearm of claim 1, wherein said firearm is a rifle.

4. The firearm of claim 1, wherein said front portion of said gun stock has a bottom surface having a primary recess formed therein;

said recoil reduction means being is mounted within said primary recess; and a cover member removably attached to said front portion of said gun stock to conceal at least a portion of said recoil reduction means.

5. The firearm of claim 4, further comprising a handgrip member having a top end and a bottom end;

said top end of said handgrip member being connected to said cover member.

6. The firearm of claim 5, further comprising a pivot pin for pivoting said handgrip member to a retracted position.

7. The firearm of claim 1, wherein said recoil reduction means is mounted in said front portion.

8. A stock for a firearm comprising:

a butt portion, a middle portion, and a front portion; and a recoil reduction means attached proximate said front portion of said stock, wherein said recoil reduction means comprises a cam roller, a lever, and a leaf spring.

9. The stock of claim 8, wherein said stock is a shotgun stock.

10. The stock of claim 8, wherein said stock is a rifle stock.

11. The stock of claim 8, wherein said front portion of said stock has a bottom surface having a primary recess formed therein and wherein said recoil reduction means is mounted within said primary recess.

12. The stock of claim 11, further comprising a cover member removably attached to said front portion of said stock to conceal at least a portion of said recoil reduction means.

13. The stock of claim 12, further comprising a handgrip member having a top end and a bottom end, wherein said top end of said handgrip member is connected to said cover member.

14. The stock of claim 13, further comprising a pivot pin for pivoting said handgrip member to a retracted position.

15. The stock of claim 8, wherein said recoil reduction means is mounted in said front portion.

* * * * *

UNITED STATES PATENT AND TRADEMARK OFFICE

CERTIFICATE OF CORRECTION

PATENT NO. : 8,201,354 B2
APPLICATION NO. : 12/798810
DATED : June 19, 2012
INVENTOR(S) : James K. Bentley It is certified that error appears in the above-identified patent and that said Letters Patent is hereby corrected as shown below:

Claim 1, under Column 8, Line 11, delete “proximate to” and insert --proximate--.

Claim 4, under Column 8, Line 19, delete “being is mounted” and insert --being mounted--.

Signed and Sealed this
Seventh Day of August, 2012

David J. Kappos

David J. Kappos
*Director of the United States Patent and Trademark Office*